US007601930B2

(12) United States Patent
De Gaillande et al.

(10) Patent No.: US 7,601,930 B2
(45) Date of Patent: Oct. 13, 2009

(54) COMPRESSION-RESISTANT HEATING FRAME

(75) Inventors: Christophe De Gaillande, Nyon (CH); Michel Piguet, Renens (CH)

(73) Assignee: Bobst S.A. (CH)

( * ) Notice: Subject to any disclaimer, the term of this patent is extended or adjusted under 35 U.S.C. 154(b) by 697 days.

(21) Appl. No.: 10/997,348

(22) Filed: Nov. 24, 2004

(65) Prior Publication Data

US 2005/0155962 A1 Jul. 21, 2005

(30) Foreign Application Priority Data

Nov. 28, 2003 (CH) ..... 2026/03

(51) Int. Cl.
*H05B 3/02* (2006.01)
*B30B 15/34* (2006.01)

(52) U.S. Cl. ..... 219/213; 219/546; 219/216; 219/243; 100/321; 100/323; 100/295; 100/325; 100/326; 100/301; 100/318; 101/21; 101/25; 101/27; 101/312; 101/480; 101/487

(58) Field of Classification Search ..... 219/243, 219/216, 213, 546; 100/321, 323, 295, 325–6, 100/301, 318; 101/21, 25, 27, 31–2, 480, 101/487, 312
See application file for complete search history.

(56) References Cited

U.S. PATENT DOCUMENTS 1,884,612 A 10/1932 Dinzl
3,181,605 A * 5/1965 Smith, Jr. ..... 165/90
4,304,178 A 12/1981 Haberle
5,156,087 A 10/1992 Cusson

* cited by examiner

*Primary Examiner*—Shawntina Fuqua
(74) *Attorney, Agent, or Firm*—Ostrolenk Faber LLP

(57) ABSTRACT

Compression-resistant heating frame, comprising an upper plate and a lower plate which are secured to each other, and a heating layer interposed between the two plates. Force-absorption studs are disposed between the two plates in order to protect the heating layer against deformation by compression of the plates against each other. The studs are distributed to permit regular heating of each plate. The force-absorption studs are distributed at the nodes of a rectangular, hexagonal or centered square network. The force-absorption studs preferably include a flange to distribute the compression force on a metal base sheet which is interposed between the upper plate and the heating means. Thermal insulation material is interposed between the heating layer and the upper plate. The heating layer may comprise a film through which an electric circuit passes in order to produce heating by joule effect.

7 Claims, 1 Drawing Sheet

COMPRESSION-RESISTANT HEATING FRAME

BACKGROUND OF THE INVENTION

The invention relates to a compression-resistant heating frame, which more particularly comprises an upper plate and a lower plate which are secured to each other.

A heating frame comprising an upper plate and a lower plate which are secured to each other is known from document CH 328013 published on 15th Apr. 1958. The frame comprises electrical heating means which are disposed between the two plates, as well as bars made of wood or of plastics material, which are disposed on both sides of the heating means, and are interposed between the upper plate and the lower plate. The resistance to compression of this frame is assured mainly by the means for securing the two plates to each other. The bars which are made of wood or of plastics material reinforce this resistance, but by transmitting all the compression forces to the heating means between which they are interposed.

A heating frame which provides improved resistance to compression is known from document EP-A-2 639 005 published on 15th Nov. 1988. According to this document, the lower plate of the frame comprises receptacles to receive the heating means, which in this case consist of electrical resistors. The receptacles are separated from one another by excess thicknesses of the lower plate, such that the electrical resistors are protected against any deformation when the frame is subjected to a force which compresses the upper and lower plates against each other. A frame of a similar type is also known from document FR 822661 published on 4th Jun. 1937. The heating elements are disposed between the upper and lower plates of the frame, and are protected against deformation by strips which maintain a space between the two plates in which the electrical resistors are disposed.

Although the last two frames described protect the heating means efficiently during compression, they nevertheless have the disadvantage of poor regularity of heating in relation to the size of the upper plate or of the lower plate. In fact, while protecting the electrical resistors against deformation, the alternation of the electrical resistors and the mechanical means, excess thicknesses or strips, creates periodic variation of the temperature of the upper and lower plates of the frame. The temperature is higher in the location of an electrical resistor, and lower in the location of the mechanical means for protection against deformation.

SUMMARY OF THE INVENTION

The object of the invention is thus to modify these existing frames so as to provide them with greater regularity of heating, while maintaining their high level of resistance to compression.

For this purpose, the object of the invention is a compression-resistant heating frame comprising an upper plate and a lower plate which are secured to each other, as well as heating means which are interposed between the two plates. The invention is characterized in that force-absorption studs are disposed between the two plates, in order to resist forces of compression of the plates against each another, while the studs are distributed to permit regular heating of each plate.

The force-absorption studs provide the frame according to the invention with considerable mechanical resistance to pressure, while permitting great thermal regularity of each plate. The heating means are protected against deformation by being disposed in a space which is created between the two plates by the force-absorption studs.

According to a first embodiment of the invention, the force-absorption studs are distributed at the nodes of a centered square geometric network. According to a second embodiment of the invention, the studs are distributed at the nodes of a hexagonal geometric network. According to a third embodiment of the invention, the force-absorption studs are distributed at the nodes of a square geometric network.

Advantageously, the heating of the frame is assured by a film which is disposed in the space created between the upper and lower plates by the force-absorption studs. This arrangement makes it possible to reduce considerably the total thickness of the frame. The heating film is comprised for example of a sheet made of plastics material, ceramic material, or mica, with a typical thickness of 1 mm. A conductor circuit is printed on one of the surfaces of the film, so as to produce by joule effect heating which can generate a heating temperature of between 150 and 200°, and can provide calorific power of approximately 10 watts per $cm^2$.

Other advantageous characteristics of the invention will become apparent from reading the description of an embodiment illustrated by the drawings.

DESCRIPTION OF THE PREFERRED EMBODIMENTS

Figure 1:
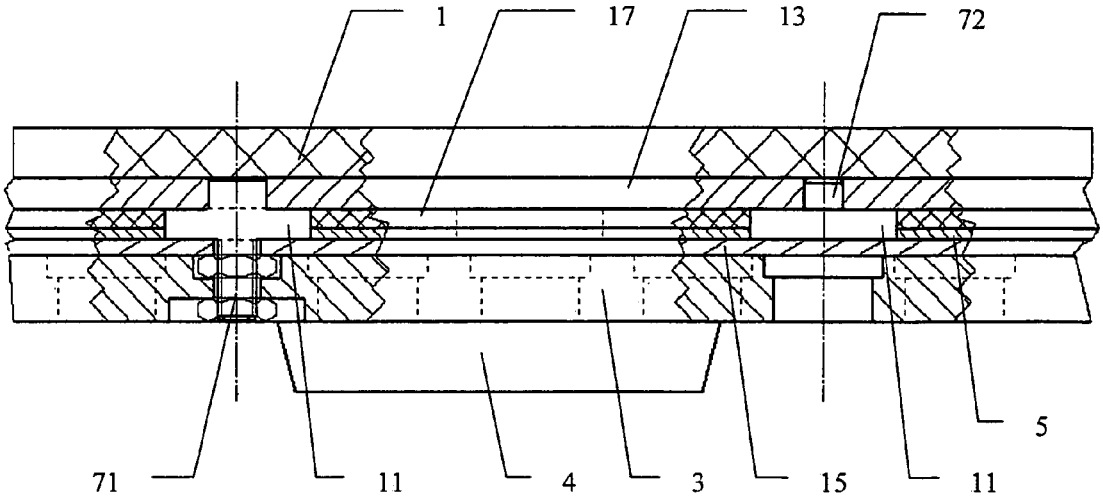
FIG. 1 is a view in cross-section of a frame according to the invention.

A compression-resistant heating frame comprises, in FIG. 1, an upper plate 1 and a lower plate 3, which are secured to each other by securing means, not shown, which may comprise for example screws which pass through the upper plate and are screwed into a thread in the lower plate. The upper plate 1 is for example a thermal insulation plate, and the lower plate has for example a honeycomb structure.

In this particular application, the frame is designed to be installed in the support beam of a press used for hot gilding of elements in the form of a plate. The gilding is deposited by hot stamping of a metallized strip onto a sheet which for example is made of cardboard, and is designed for production of packaging. Blocks 4 are secured to the lower plate 3 and are heated by the frame in order to reach a temperature which is typically between 100° C. and 200° C.

The increase and maintenance of the temperature of the frame is assured by heating means 5 interposed between the upper 1 and lower 3 plates.

According to the invention, force-absorption studs 71, 72 are disposed between the two plates 1 and 3 in order to resist compression forces of the plates against each other, and the studs are distributed so as to permit regular heating of each plate. As illustrated by FIG. 1, the heating means 5 are interposed between the two plates 1 and 3 of the frame, and are disposed in a space created between these two plates by the force-absorption studs 71, 72. The force-absorption studs 71, 72 thus protect the heating means 5 against deformation when the frame is subjected to a compression force, while the dimension of these means for protection is decreased relative to the size of the plates of the frame. This results in improved cover of the plates by the heating means, leading to improved thermal regularity of the frame.

Figure 2A:
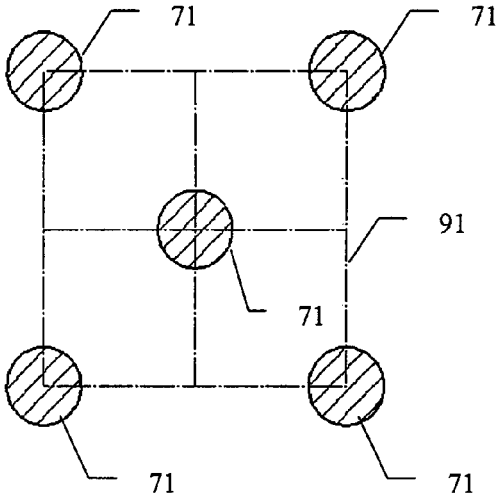
FIGS. 2*a* and 2*b* schematically represent the distribution of the force-absorption studs at the nodes respectively of a centered square and centered hexagonal network.
Figure 2B:
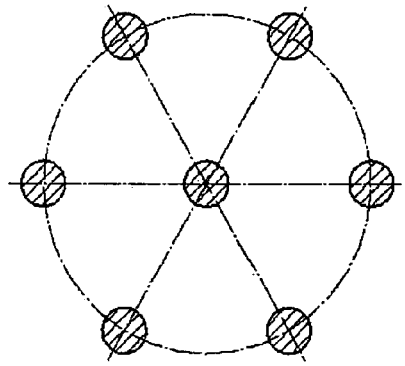

The force-absorption studs 71, 72 are preferably distributed at the node of a geometric network. As illustrated by FIG. 2, the force-absorption studs 71, 72 are distributed at the node of a centered square network 91. Other geometric networks are also provided, such as, for example, a hexagonal network or a square network.

With a centered rectangular network, the force-absorption studs are distributed at the four corners of a rectangular elementary pattern, and a fifth stud is disposed at the center of the rectangle. In a hexagonal network, the studs are disposed at the intersection in pairs of the six sides of a hexagon. Finally, in a square geometric network, the force-absorption studs are disposed at the four corners of the square.

By way of example, distribution according to the centered square network 91 illustrated by FIG. 2 makes it possible to regularize the temperature of the lower plate 3 of the frame illustrated by FIG. 1, to a value of 160° C., for a local decrease in the temperature in the location of the force-absorption studs 7 which is less than 1° C. when the plate is left in the open air.

Figure 3A:
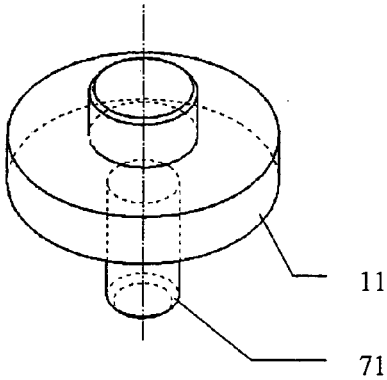
FIGS. 3*a* and 3*b* represent respectively a detailed view of one of the force-absorption studs of the frame illustrated by FIG. 1.
Figure 3B:
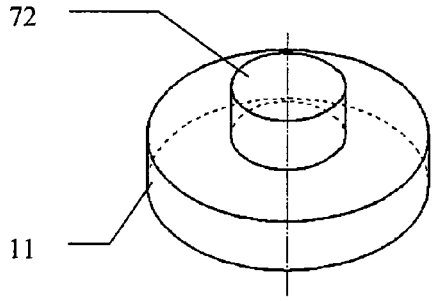

As illustrated by FIGS. 1 and 3, the force-absorption studs 71, 72 are provided with a flange 11 in order to distribute the compression forces onto a metal base sheet 13 which is interposed between the upper plate 1 and the heating means 5. This arrangement advantageously makes it possible to decrease the pressure exerted by the force-absorption studs 71, 72 on the upper plate 1. This permits selection of a material which is less highly resistant to compression in order to produce the upper plate 1 in the form of a thermal insulation plate, such as an epoxy resin filled with glass fibers.

The flange 11 of the force-absorption studs 71, 72 can be supported directly on the lower plate 3 or on a metal closure sheet 15 which is interposed between the heating means 5 and the lower plate 3. The closure sheet 15 is selected such as to diffuse the heat rapidly over the entire extent of the lower plate 3, in order to contribute to the good thermal regularity of the frame.

It should be noted that the force-absorption studs 71, 72 provided with the flanges 11 can extend through the lower plate 3 (studs with the reference 71), or extend only between the upper plate 1 and the metal closure sheet 15 (studs with the reference 72). These two types of force-absorption studs are illustrated more particularly respectively by FIGS. 3*a* and 3*b*.

A thermal insulation material, for example a ceramic felt 17, is interposed between the heating means 5 and the upper plate 1, in order firstly to limit the thermal heating of the upper plate 1, and secondly to compress the heating means 5 so as to guarantee good thermal contact between these heating means and the closure sheet 15 or the lower plate 3.

As previously stated, the heating means preferably consist of a film which is disposed between the lower 3 and upper 1 plates, and is provided with holes in order to permit the passage of the force-absorption studs 71, 72. This arrangement makes it possible to reduce considerably the total thickness of the frame. A reduction of this type in the dimensions permits transformation of presses used initially for cutting purposes, into presses for carrying out operations of transfer of hot-metallized strips.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A compression-resistant heating frame, comprising:

an upper plate and a lower plate which are secured to each other;

a heating layer interposed between the two plates;

a metal base sheet interposed between the upper plate and the heating layer;

force-absorption studs disposed between the two plates, the studs are sized to protect the heating layer against deformation by compression of the plates against each other, the studs are distributed over the plate to permit regular heating of each plate, and the studs include a flange which is shaped to distribute the compression forces on the metal base sheet.

2. A frame according to claim 1, wherein the force-absorption studs are distributed at nodes of a rectangular, hexagonal or square network.

3. A frame according to claim 1, wherein the flange of the force-absorption studs is supported on the lower plate.

4. A frame according to claim 1, further comprising a metal closure sheet interposed between the heating layer and the lower plate on which the force-absorption studs are supported.

5. A frame according to claim 1, further comprising a thermal insulation material interposed between the heating layer and the upper plate.

6. A frame according to claim 1, wherein the heating layer comprises a film through which an electric circuit passes in order to produce heating of the heating layer by joule effect.

7. A frame according to claim 1, wherein the upper plate is a thermal insulation plate and the lower plate has a honeycomb structure.

* * * * *